United States Patent [19]

Kuchler

[11] Patent Number: 4,598,618

[45] **Date of Patent: * Jul. 8, 1986**

[54] FOOD-SLICING MACHINE AND METHOD

[75] Inventor: Fritz Kuchler, Klagenfurt, Austria

[73] Assignee: Brain Dust Patents Establishment, Vaduz, Liechtenstein

[ * ] Notice: The portion of the term of this patent subsequent to Aug. 12, 1997 has been disclaimed.

[21] Appl. No.: 646,624

[22] Filed: Aug. 31, 1984

Related U.S. Application Data

[60] Division of Ser. No. 415,398, Sep. 7, 1981, abandoned, which is a continuation of Ser. No. 143,929, Apr. 24, 1980, Pat. No. 4,379,416, which is a continuation-in-part of Ser. No. 911,289, May 31, 1978, Pat. No.

[30] Foreign Application Priority Data

| | | | |
|---|---|---|---|
| Jun. 1, 1977 | [AT] | Austria | 3858/77 |
| Jun. 1, 1977 | [AT] | Austria | 3859/77 |
| Sep. 13, 1978 | [AT] | Austria | 6603/78 |

[51] Int. Cl.[4] ..... B26D 7/30; B26D 7/32

[52] U.S. Cl. ..... 83/77; 83/88; 83/713; 83/365

[58] Field of Search ..... 83/73, 80, 88, 69, 77, 83/713

[56] References Cited

U.S. PATENT DOCUMENTS

| | | | |
|---|---|---|---|
| 3,834,259 | 9/1974 | Kuchler | 83/80 X |
| 4,181,053 | 1/1980 | Duddridge | 83/80 |
| 4,185,527 | 1/1980 | Kuchler | 83/88 |
| 4,217,650 | 8/1980 | Kuchler | 83/713 X |
| 4,258,530 | 3/1981 | Mukumoto | 83/88 X |
| 4,379,416 | 4/1983 | Kuchler | 83/72 X |

*Primary Examiner*—Donald R. Schran

*Attorney, Agent, or Firm*—Karl F. Ross; Herbert Dubno

[57] ABSTRACT

A foodstuff such as a sausage is sliced in a predetermined slicing direction into a succession of slices each having a respective width measured parallel to the slice direction. This succession of slices is then deposited on a support in a plurality of rows with the slices in each row offset from one another by a predetermined first distance and the rows offset from each other by a predetermined second distance. The width of the slices is continuously measured as they are cut and at least one of the distances is automatically varied in dependence on the measured width to produce a uniformly overlapping array of slices. In addition the machine can calculate the weight of a given slice by combining the width with the slice thickness and the slice density, and this weight can be divided into a desired weight to determine how many slices at the predetermined size are needed to make up the desired weight. A signal can indicate then when this weight is reached.

2 Claims, 4 Drawing Figures

FOOD-SLICING MACHINE AND METHOD

CROSS-REFERENCE TO RELATED APPLICATIONS

This application is a division of application Ser. No. 415,398 filed Sept. 7, 1981, now abandoned and which application is a continuation of application Ser. No. 143,929 (filed Apr. 24, 1980 and issued Apr. 12, 1983 as U.S. Pat. No. 4,379,416) as a continuation-in-part of applications Ser. No. 911,289 (filed May 31, 1978 and issued Aug. 12, 1980 as U.S. Pat. No. 4,217,650), Ser. No. 911,290 (filed May 31, 1978 and abandoned June 03, 1981), and Ser. No. 074,775 (filed Sept. 12, 1979 and abandoned July 02, 1980).

FIELD OF THE INVENTION

The present invention relates to a method of and an apparatus for cutting a foodstuff such as sausage into slices and arranging the slices. More particularly this invention concerns an automatic slicing and arranging machine.

BACKGROUND OF THE INVENTION

A slicing machine is known for use on foodstuffs such as sausage, cheese, boned meat, sandwich loaf, and the like which automatically cuts a succession of slices from the foodstuff, and then deposits the slices in a plurality of rows on a support. Such a device is described, for example, in my U.S. Pat. Nos. 3,834,529 and 4,185,527, my Austrian Pat. No. 324,874, and my copending application No. 911,289.

It is possible for such a system to have a conveyor belt provided with a multiplicity of upstanding pins and positioned to receive the slices from the blade and deposit them at appropriate locations on the substrate. The substrate itself may be movable, and it is even possible to provide a fixed deposition location and a substrate which is displaceable in two horizontal and mutually orthogonal directions. A pivotal deposition arrangement may also be provided in combination with a movable or even fixed substrate for forming a two-dimensional slice display. Such a display finds particular use in the production of attractive packages of cold cuts and the like wherein the slices are offset from each other so that the consumer can see the product clearly.

Such a system normally has adjustments which allow the offset between adjacent slices in a given row of the array to be made as well as an adjustment for the spacing between adjacent rows. Thus when a foodstuff of relatively large diameter is cut these spacings are set relative large, whereas for a smaller foodstuff the spacings are made small.

The disadvantage of such a system is that many elongated foodstuffs are not of perfectly uniform width from one end to the other. Thus as the slices are being cut from the end, for example, of a salami, the relatively large spacing usable in the middle of the salami will be so great that the slices will lie totally separate from one another and the package thus produced will be unattractive. Furthermore time-consuming adjustment is needed each time foodstuff size is changed.

Another problem in the food business is that the slicing of wurst, cheese and the like is effected in two separate operations on different devices. Modern automatic slicing machines can by means of a laying-off device array the slices on the entire surface of a rectangular laying-off plate or on a round platter. Electronic calculating scales allow not only an indication of the weight but can also calculate the price based on the programmed unit weight price.

Practice has shown that each of these machines has reached a relatively high state of perfection that does not, however, eliminate the repetitive labor and time expense of the slicing on the slicing machine, checking the weight throughout, additional slicing, and reweighing. Thus each time the weight is checked the waxed paper with the slices on it must be taken off the slicing machine, placed on the scale, and then laid back on the output side of the slicing machine for further slicing. Only an experienced salesperson can estimate weight based on quantity with any degree of accuracy, and even then only if the quantity is of a familiar magnitude, such as 10 dkg. Constant rechecking of the weight during an automatic operation interferes with the arrangement of the slices in a pattern and thus destroys their appearance on the platter. It is to be noted further that at present many persons are employed who are not competent to judge weight based on sliced amounts.

OBJECTS OF THE INVENTION

It is therefore an object of the present invention to provide an improved method of and apparatus for cutting a foodstuff into slices and arranging the slices.

Yet another object is to provide an improved automatic slicing machine and method.

SUMMARY OF THE INVENTION

These objects are attained according to the instant invention by providing a slicing and arranging machine with means for continuously measuring the width of the slices cut in a direction perpendicular to the slice direction, and for automatically varying the distance by which slices are offset from each other in a given row and/or the distance by which the rows are relatively offset to one another. Thus with the system according to the instant invention the machine automatically compensates for foodstuffs of different cross-sectional sizes. EVen with a sausage or the like of varying diameter or cross-sectional width the machine will automatically deposit the slices as they are made in a uniformly overlapping and attractive array.

According to this invention the diameter of the foodstuff constituting the workpiece is determined by driving the blade disk with an electric motor that is connected to a current or speed sensor. Similarly the position of the table relative to the blade is continuously monitored by means of a simple slide potentiometer or the like. The current or speed sensor is set up to generate an output at least when the current consumption by the drive motor increases or when the motor speed decreases, both such conditions indicating contact of the blade disc with the foodstuff. When this output is generated it is combined with a signal indicative of the relative positions of the table and the blade to produce another output signal that indicates a radial dimension such as the diameter of the foodstuff. This last-mentioned output is fed to a controller that controls the stepping of the depositing apparatus.

The depositing apparatus according to this invention may have a belt provided with a plurality of upstanding spikes or pins into which the slices are sequentially dropped from the blade, and which is set up so as to deposit the slices sequentially at spaced-apart locations at a given direction. The support receiving these slices can be movable in steps in a direction perpendicular to the direction of the rows for forming of an array extending in two dimensions.

With the system according to the present invention it is therefore possible to form slice arrays of uniform overlap using relatively small foodstuffs, such as peperoni, as well as relatively large foodstuffs, such as mortadella. No adjustment is needed when the type of foodstuff is changed, as only the initial overlap need be set so that thereafter the machine will automatically adjust the spacing within a row as well as the spacing between rows according to diameter or width. In fact it is possible to mix foodstuffs of different sizes and still obtain a neatly overlapping and attractive array.

According to another feature of this invention the weight of a slice being cut is determined in accordance with the system described in my above-cited copending application Ser. No. 911,289, whose entire disclosure is herewith incorporated by reference. The user can also punch into an input device of the slicing machine a desired overall weight and then cut a succession of slices off a foodstuff such as a wurst. According to the present invention means is provided which is connected to this input means and to the weight-estimating means for emitting a signal when the overall weight of the succession of slices corresponds to the desired weight, by which is meant the overall weight is relatively closer than if the succession had one more or one less slice.

This last-given advantage of the instant invention is achieved either very simply by dividing the desired weight by the weight of the first slice cut to obtain a slice number, and then to count the slices until this slice number is reached, or by adding the weight of each slice as it is cut to the overall weight of the slices in the succession already cut until the desired weight is reached. As the weight-estimating system according to my earlier application is relatively accurate—frequently within 2–3% of the actual weight—such an arrangement allows sandwiches and the like to be made up with complete uniformity of meat content.

The slicing machine can be made to automatically check the weight for one or two slice thicknesses, and it is also possible to provide a generator having an input connected to the slice-thickness setting device and an output connected with an input of the electronic circuit.

The determining of the slice number can be made in a microprocessor for all thicknesses. A particularly useful and advantageous embodiment of the invention is characterized in that an input device, for example a keyboard or a rotary knob, is provided for setting the desired weight, and is connected to one input of the microprocessor, and that for each loaded-in desired weight in the microprocessor the slice-number signal is determined in dependence on the slice-thickness signal from a generator and from the signal from a slice-size feeler, and that the slice-number signal is fed to one of the inputs of a comparator. In this manner maximum ease of operation is achieved that allows any weight value desired by the customer to be loaded in by the input device or set so that when the slice number corresponding to this weight is reached a signal is generated. This signal can also be optical, illuminating at the desired weight value on an indicator so as to be particularly clear and informative.

Of course after the completed slicing operation a final weighing on a certified scale or calculating scale is necessary. The machine according to the instant invention is, however, capable of closely approximating the actual weight.

SPECIFIC DESCRIPTION

Figure 1:
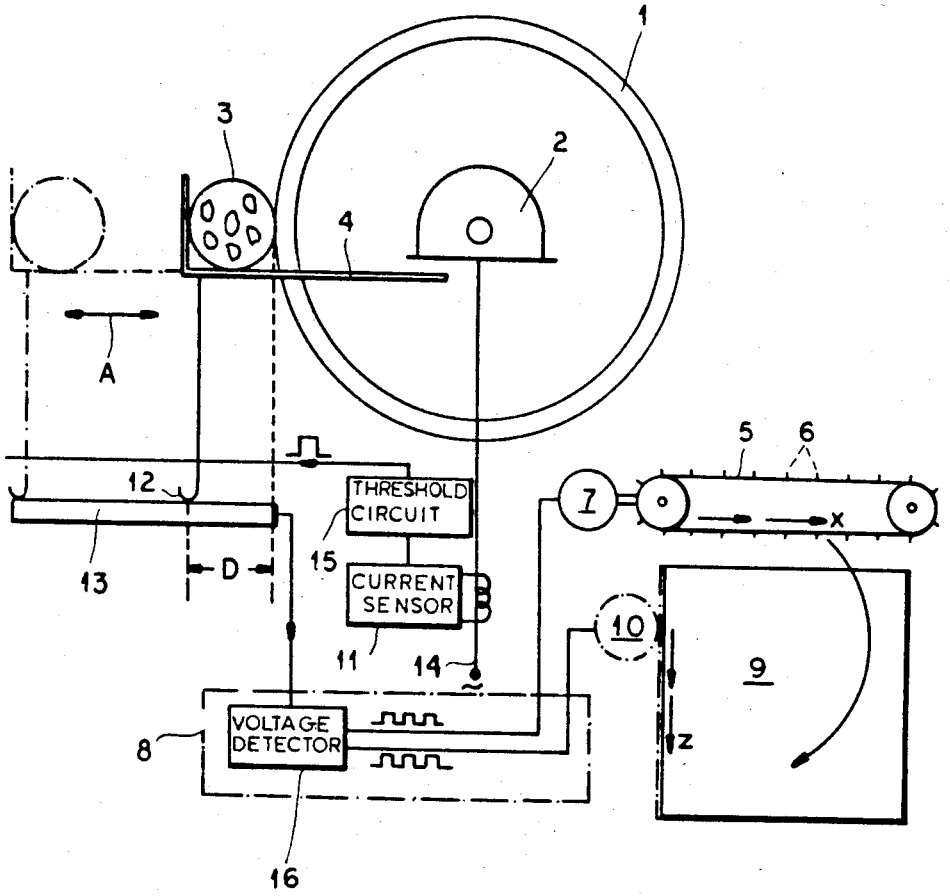
FIGS. 1–3 are largely schematic views illustrating slicing machines according to the instant invention.

According to the instant invention as shown in FIG. 1 a circular disk blade 1 is rotated by an electric motor 2 so as to cut a sausage 3 here supported on an L-section table 4 reciprocal horizontally in a direction A radially of the disk 1. After being cut the slices are deposited sequentially on a short horizontal conveyor belt 5 having upstanding spikes 6 and driven by a motor 7 in a direction A radially of the disk 1. After being cut the slices are deposited sequentially on a short horizontal conveyor belt 5 having upstanding spikes 6 and driven by a motor 7 in a direction x such that the slices can be dropped on a support table 9 by the belt 5 at any point along the lines defined by the direction x. This table 9 in turn can be displaced in a horizontal direction z perpendicular to the direction x by means of a motor 10 driven, like the motor 7, from a controller 8.

More particularly, as described in the above-cited Austrian Pat. No. 324,874 issued Sept. 25, 1975 to the instant inventor, the belt 5 is spanned over rollers which rotate about axes lying in a plane perpendicular to the disk blade 1 and to the rotation axis thereof. At the closest point of approach between the belt 5 and the disk blade 1 the spikes 6 automatically pick the just cut slice off the blade 1 and transport it in direction x along the table 9. The drive motor 7 for the belt 5 is operated as will be described in more detail below by the controller 8 to stop at a location along the table 9 in the direction x as established by the slice dimension in the slice direction A, which is determined as also described below, and by the position where the previous slice was deposited, as established in the memory of the controller 8. An automatic stripping arm automatically pushes the just cut slice off the spikes 6 at the appropriate position along the table 9. Once a complete row is formed on the table in the direction x the motor 10 is actuated to step the table 9 in the direction z for formation of another row.

The motor 2 is connected to a source 14 of electrical energy, here alternating-current line voltage, through a current sensor 11 that is connected via a threshold circuit to the wiper 12 of a potentiometer 13. This wiper 12 is directly linked to the table 4 and the potentiometer is connected to the input of a controller/microprocessor 8 to feed thereto a signal inversely proportional to the diameter D of the sausage 3 being sliced. The current sensor 11, which may also be a motor-speed sensor, generates an analog output proportional to the current drawn by the motor 2 and feeds it to the threshold circuit 15 that generates an analog output proportional to the current drawn by the motor 2 and feeds it to the threshold circuit 15 that generates a pulse output when the signal it receives from the sensor 11 exceeds a predetermined lower limit. Thus whenever the motor 2 is loaded or slowed down, as happens when the cutting edge of the blade 1 bites into the sausage 3, the current consumption of this motor 2 will increase suddenly and the circuit 15 will start generating its pulse output, which continues until the current consumption decreases below the lower limit or threshold, which of course can be set at any level by the user depending on foodstuff hardness.

The pulse generated by the circuit 15 is attenuated by the potentiometer to an extent directly proportional to the diameter of the sausage, so that with a large sausage the resistance across the potentiometer will be relatively great and vice versa. The voltage of the pulse once it passes through the potentiometer 13 is therefore inversely proportional to the diameter D of the sausage or the other wurst 3.

The controller 8 includes a voltage detector 16 that receives the output of the potentiometer 13 and generates each time it receives a voltage input a series of pulses having a number inversely proportional to the voltage of its input, therefore directly proportional to the diameter D of the sausage 3 being sliced. This pulse output is in turn fed to stepping motors 7 and 10 respectively responsible for displacement of the sausage slice in the direction x and the displacement of the table 9 in the orthogonal direction z. Thus as sausage diameter increases, the spacing between adjacent slices will be increased and vice versa.

If the foodstuff 3 is square rather than round in section it is possible with minor adjustment of the controller 8 to use the dimension D similarly. The system will work well even when other than a cylindrical foodstuff is being sliced.

It is also possible to use the output of the potentiometer D to calculate the weight of the slices being cut, as described in my jointly filed copending application cited above. This is achieved by squaring the factor D and multiplying it by a factor of $\pi/4$ or by halving the diameter D, then squaring it times $\pi$. Thereafter this product is multiplied by the thickness of the slices, and thereafter by their density to produce the weight. The weights of succeeding slices can be added together and displayed so that, for example, a vendor can ascertain at any time during a slicing operation the overall weight of the slices cut.

Figure 2:
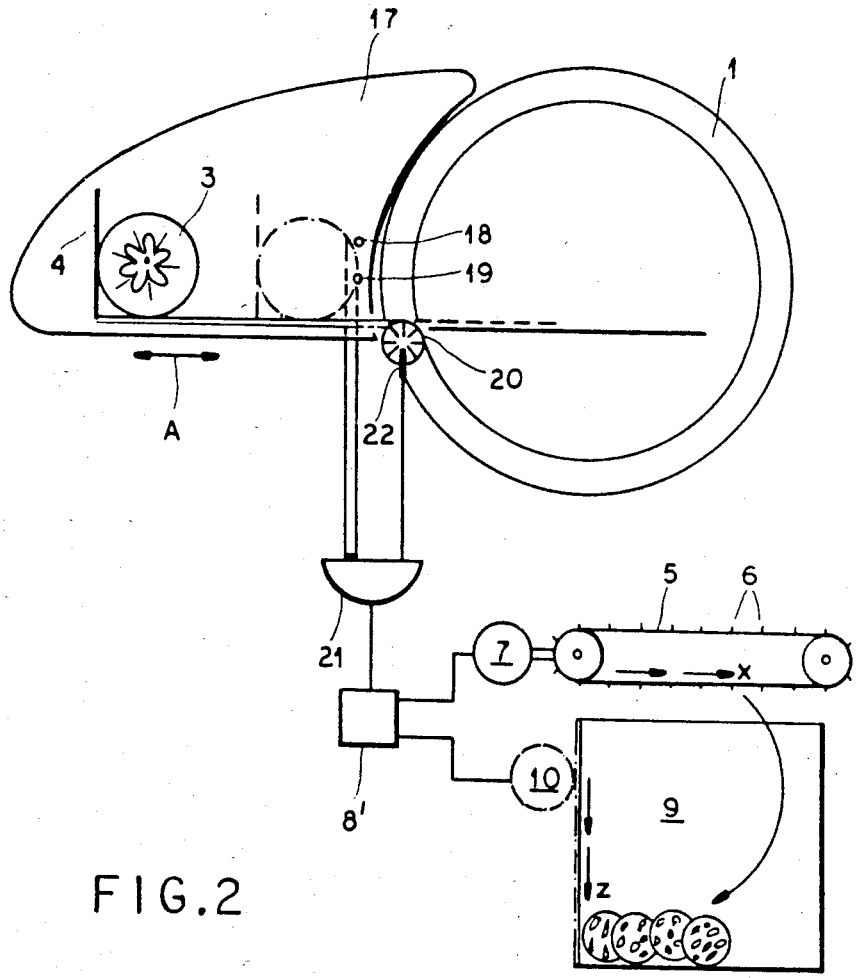

FIG. 2 shows an arrangement similar to that of FIG. 1 and wherein the same reference numeral as of FIG. 1 are used for identical structure. Here, however, the means for determining the diameter D of the sausage 3 is constituted by a pair of photocells 18 and 19 connected to one input of an AND gate 21 and set up to generate outputs when they are covered by the sausage 3 as it is slid along the slide plate 17 by the table 4. In addition a notched wheel 20 is positioned between a light source (not illustrated) and a photocell 22 and is driven by the table 4. The photocell 22 is connected to a controller 8' which is in turn connected to the stepping motors 7 and 10.

With this arrangement the photocell 22 therefore generates pulses with each pulse corresponding to a predetermined displacement in the direction A of the foodstuff support 4. These pulses only pass through the AND gate 21 when its other input connected to the photocells 18 and 19 is also energized, which only occurs when the sausage 3 covers them. Thus the AND gate 21 will generate pulses starting at the instant the sausage 3 covers the cells 18 and 19 and stops generating pulses when they are again uncovered. Thus the number of pulses generated each time the support 17 is displaced back and forth will be directly proportional to the diameter D and will, consequently, displace the sausage slice a distance proportional to its size in the directions x and z. The arrangement is normally set up to ignore the pulse train generated during the return stroke of the table 17.

It is possible to use an array of angularly equispaced magnets on the disk 20 driven by the support 17, and to replace the photocell 22 with a reed switch to generate the pulse train as the support moves. The main concept is just to generate a signal that corresponds to the sausage diameter, so the arraying mechanism can deposit the slice with an overlap determined by its diameter.

Figure 3:
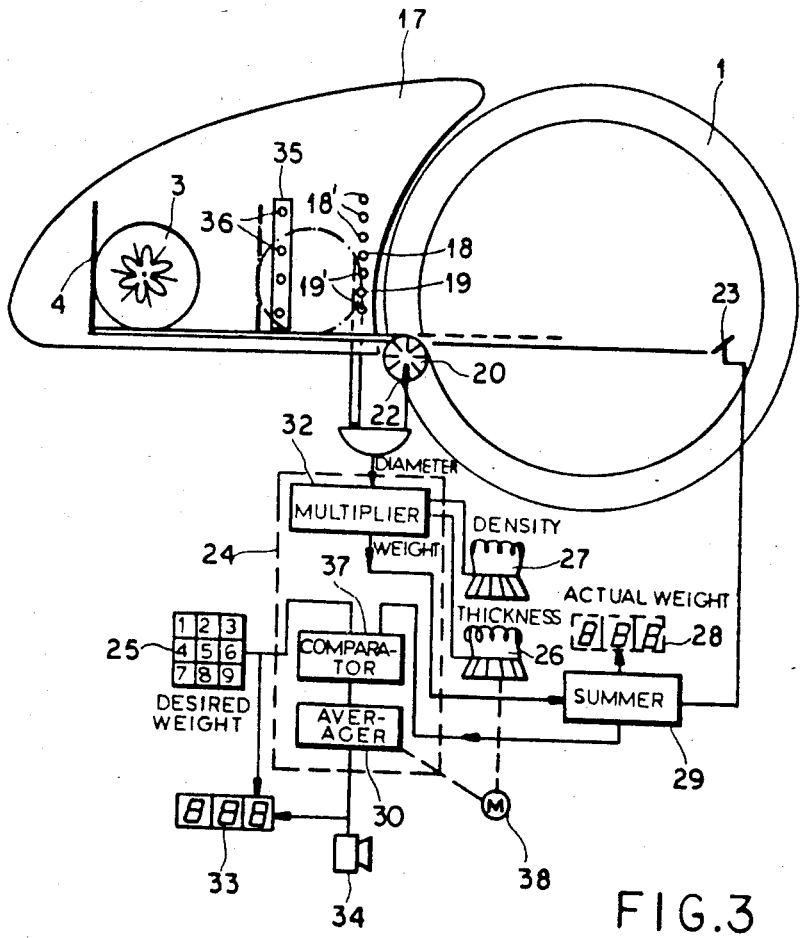

FIG. 3 shows another arrangement according to the instant invention which serves to generate a signal when the weight of the slices cut corresponds to a preselected weight so that, for instance, a sandwich maker in a delicatessen can put uniform quantities of meat in the sandwiches he or she makes.

This is achieved in an arrangement similar to that of FIG. 2, but wherein the diameter signal formed by the AND gate 21 is fed to a multiplier 32 of a microprocessor 24 to which is also fed a density signal from a density input 27 and a slice-thickness signal from the slice-adjustment knob 26 of the machine. The diameter is halved, squared, and multiplied by pi, then by the density and then by the thickness of the slice in the multiplier 32 to form a weight signal that is fed to a summer 29. Each time the foofstuff support 4 reaches the inward end of its stroke it actuates a switch 23 which adds to the aggregate weight in the summer the weight of the slice just cut as determined in the multiplier to produce an output corresponding to the overall aggregate weight which is displaced at 28 and fed to a comparator 37.

A desired-weight input keyboard 25 is also connected to this comparator 37 and to a display 33 for the average weight. When the desired and actual weights correspond a signal is produced from the comparator 37 which drives an acoustic signaler 34 such as a horn, and that also causes the display 33 to increase in brightness or flash, indicating that the desired weight has been sliced. An averager 30 connected to the comparator 37 and connected via a servomotor 38 to the slice-thickness adjustment knob 26 may even increase or decrease the thickness of the last slice to make the cut weight correspond as closely as possible to the desired weight.

FIG. 3 also shows how, in addition to the two photocells 18 and 19, further photocells 18' and 19' may be provided in a vertical row to allow the diameter to be read simply by detecting how much of the row is covered by the wurst 3. Also a silicon-rubber panel 35 in the plate 17 may be provided with switches 36 or photocell-light reflectors to mesure the diameter or height of the wurst 3.

Figure 4:
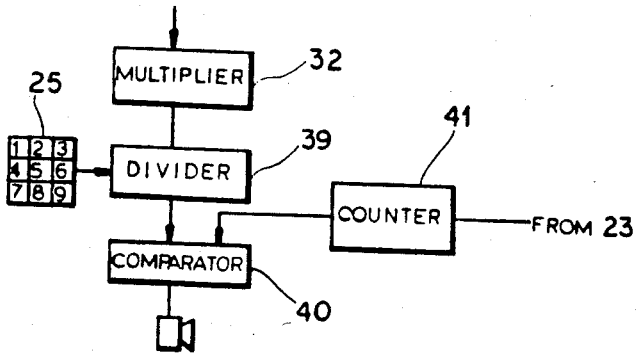
FIG. 4 is a detail view of an alternative arrangement to the machine of FIG. 3.

The arrangement described above can also be substantially simplified if it is assumed that all the slices in a given batch are of the same weight. In such an arrangement a divider would divide the desired weight by the weight of the first slice cut to obtain a slice number which would be compared with the number of slices actually cut. Once the two numbers agreed the signal would be emitted. Thus as seen in FIG. 4 the weight output from the multiplier 32 would be fed to a divider 39 whose output would be compared in a comparator 40 with the output of a counter 41 connected to the switch 23. The comparator 40 is connected to the acoustic signal 34. In this arrangement therefore the elements 37 and 30 of the FIG. 3 arrangement are not used.

I claim:

1. A slicing machine comprising:

a blade;

a foodstuff support adapted to support an elongated foodstuff and displaceable in a slicing direction past said blade to cut a slice from said foodstuff;

weight-estimating means connected to said support and including a means for measuring the surface area of the slice being cut in the form of a vertical row of photocells for generating an output proportional to the weight of the slice cut from said foodstuff as said support is displaced past said blade;

input means for generating an output corresponding to a desired weight; and signal means connected to said weight-estimating and input means for producing a signal when the overall weight of the given succession of slices corresponds to said desired weight.

2. An apparatus for preparing foodstuff slices comprising:

means for slicing the foodstuff in a predetermined slice direction perpendicular to a longitudinal dimension of the foodstuff into a succession of slices each having a respective width measured parallel to the slice direction;

a support;

means for depositing the succession of slice on said support in a plurality of rows with the slices in each row offset from one another by a predetermined first distance;

means for relatively offsetting the rows by a predetermined second distance;

means including at least one sensor in the form of a photocell fixed adjacent said support and generating an output when the foodstuff is displaced past the sensor for continuously measuring the width of the slices; and means for continuously and automatically varying at least one of the distances in dependence upon the measured width.

* * * * *